US009917345B2

(12) United States Patent
Gregoire et al.

(10) Patent No.: US 9,917,345 B2
(45) Date of Patent: Mar. 13, 2018

(54) METHOD OF INSTALLING ARTIFICIAL IMPEDANCE SURFACE ANTENNAS FOR SATELLITE MEDIA RECEPTION

(71) Applicant: HRL LABORATORIES, LLC, Malibu, CA (US)

(72) Inventors: Daniel J. Gregoire, Thousand Oaks, CA (US); Joseph S. Colburn, Malibu, CA (US)

(73) Assignee: HRL Laboratories, LLC, Malibu, CA (US)

( * ) Notice: Subject to any disclaimer, the term of this patent is extended or adjusted under 35 U.S.C. 154(b) by 1323 days.

(21) Appl. No.: 13/752,195

(22) Filed: Jan. 28, 2013

(65) Prior Publication Data

US 2014/0208581 A1 Jul. 31, 2014

(51) Int. Cl.

| | |
|---|---|
| ***H01Q 1/12*** | (2006.01) |
| ***H01Q 1/22*** | (2006.01) |
| ***H01Q 1/38*** | (2006.01) |
| ***H01Q 13/28*** | (2006.01) |
| ***H01Q 15/00*** | (2006.01) |

(52) U.S. Cl.

CPC ..... *H01Q 1/22* (2013.01); *H01Q 1/125* (2013.01); *H01Q 1/38* (2013.01); *H01Q 13/28* (2013.01); *H01Q 15/006* (2013.01); *Y10T 29/49016* (2015.01)

(58) Field of Classification Search

CPC ..... H01Q 1/1221; H01Q 1/22; H01Q 13/28; H01Q 1/125; H01Q 1/38; Y10T 29/49016

See application file for complete search history.

(56) References Cited

U.S. PATENT DOCUMENTS

| | | | | |
|---|---|---|---|---|
| 4,630,064 A | | 12/1986 | Andrews et al. | |
| 5,227,807 A | | 7/1993 | Bohlman et al. | |
| 5,572,228 A | * | 11/1996 | Manasson | H01Q 3/02 333/248 |

(Continued)

FOREIGN PATENT DOCUMENTS

| | | |
|---|---|---|
| JP | 05-199034 | 8/1993 |
| JP | 06-069717 | 3/1994 |

(Continued)

OTHER PUBLICATIONS

From Chinese Application No. 201380004106.2, PRC Office Action dated Oct. 26, 2015 with English summary.

(Continued)

*Primary Examiner* — Livius R Cazan

(74) *Attorney, Agent, or Firm* — Ladas & Parry

(57) ABSTRACT

A method for fabricating and installing an artificial impedance surface antenna (AISA) includes locating a substantially flat surface having a line of sight to a satellite or satellites of interest, determining an angle $\theta_o$ between a normal to the substantially flat surface and a direction to the satellite or satellites of interest, selecting an antenna superstrate from a pre-fabbed stock of antenna superstrates, the selected antenna superstrate configured for having a peak radiation within two (2) degrees of the angle $\theta_o$, laminating the selected antenna superstrate to an antenna substrate to form the AISA, and mounting the AISA on the substantially flat surface.

20 Claims, 7 Drawing Sheets

(56) References Cited

U.S. PATENT DOCUMENTS

| | | | |
|---|---|---|---|
| 5,619,218 | A | 4/1997 | Salvail et al. |
| 5,712,647 | A | 1/1998 | Shively |
| 6,369,778 | B1 | 4/2002 | Dockery |
| 6,466,177 | B1 | 10/2002 | Kunysz |
| 7,218,281 | B2 | 5/2007 | Sievenpiper |
| 7,427,961 | B2 | 9/2008 | Song et al. |
| 7,830,310 | B1 | 11/2010 | Sievenpiper |
| 7,898,498 | B2 | 3/2011 | Higashi et al. |
| 7,911,407 | B1 | 3/2011 | Fong |
| 2007/0001909 | A1 | 1/2007 | Sievenpiper |
| 2009/0002240 | A1 | 1/2009 | Sievenpiper |
| 2010/0156749 | A1 | 6/2010 | Kim |
| 2011/0209110 | A1 | 8/2011 | Grbic et al. |
| 2012/0068896 | A1 | 3/2012 | White et al. |
| 2012/0194399 | A1 | 8/2012 | Bily et al. |

FOREIGN PATENT DOCUMENTS

| | | |
|---|---|---|
| JP | 08-008638 | 1/1996 |
| JP | 07-142916 | 6/2005 |
| JP | 06-112730 | 4/2014 |
| KR | 10-2004-0026205 | 3/2004 |
| TW | 200711221 | 3/2007 |

OTHER PUBLICATIONS

From U.S. Appl. No. 13/427,682 (Now U.S. Pat. No. 8,830,129), Notice of Allowance dated May 5, 2014.

From U.S. Appl. No. 13/931,097 (Unpublished, Non-Publication Requested), Final Rejection dated Oct. 19, 2015.

From U.S. Appl. No. 14/092,276 (Now Published as 2015/0145748), Ex Parte Quayle Action dated Oct. 27, 2015.

From U.S. Appl. No. 13/931,097 (unpublished; Non-publication request), Non-Final Office Action dated Apr. 7, 2015.

From U.S. Appl. No. 13/931,097, Application and Office Actions.

From U.S. Appl. No. 13/427,682, Application and Office Actions including but not limited to the Office Action dated Jan. 30, 2014.

From U.S. Appl. No. 14/092,276, Application and Office Actions.

PCT International Preliminary Report on Patentability (Chapter II) dated Feb. 7, 2014 for related PCT Application No. PCT/US2013/031079.

PCT International Search Report and Written Opinion dated Jun. 27, 2013 for related PCT Application No. PCT/US2013/031079.

Collin, "Field theory of guided waves, 2nd Ed.", IEEE Press, 1996, pp. 705-708.

Gregoire and Colburn, *Artificial impedance surface antenna design and simulation*, Proc. Antennas Appl. Symposium 2010, pp. 288-303.

Gregoire and Colburn, *Artificial impedance surface antennas*, Proc. Antennas Appl. Symposium 2011, pp. 460-475.

Luukkonen et al, "Simple and accurate analytical model of planar grids and high-impedance surfaces comprising metal strips or patches", IEEE Trans. Antennas Prop., vol. 56, 1624, 2008.

Minatti and Maci et al, "Spiral Leaky-Wave Antennas Based on Modulated Surface Impedance", IEEE Trans. on Antennas and Propagation, vol. 59, No. 12, Dec. 2011.

Patel, A.M.; Grbic, A., "A Printed Leaky-Wave Antenna Based on a Sinusoidally-Modulated Reactance Surface," Antennas and Propagation, IEEE Transactions on , vol. 59, No. 6, pp. 2087,2096, Jun. 2011.

Sievenpiper et al, "Holographic AISs for conformal antennas", 29th Antennas Applications Symposium, 2005.

Sievenpiper, 2005 IEEE Antennas and Prop. Symp. Digest, vol. 1B, pp. 256-259, 2005.

U.S. Appl. No. 13/427,682, filed Mar. 22, 2012, Gregoire.

D. Gregoire and J. Colburn, "Artificial impedance surface antenna design and simulation", Proc. 2010 Antenna Applications Symposium, pp. 288.

J. S. Colburn et al., "Scalar and Tensor Artificial Impedance Surface Conformal Antennas", 2007 Antenna Applications Symposium, pp. 526-540.

B.H. Fong et al, "Scalar and Tensor Holographic Artificial Impedance Surfaces", IEEE Trans. Antennas Propagation, accepted for publication, 2010.

From European Patent Application No. 13763659.3, EPO Office Action dated Apr. 26, 2016.

From U.S. Appl. No. 13/931,097 (Unpublished, Non-Publication Requested), Non-Final Rejection dated May 31, 2016.

International Search Report and Written Opinion from PCT/US2014/064404 dated Feb. 13, 2015.

Felix K. Schwering et al., Design of Dielectric Grating Antennas for Millimeter-Wave Applications, IEEE Transactions on Microwave Theory and Techniques, IEEE Service Center, Piscataway, NJ, US, vol. MTT-31, No. 2, pp. 199-209 (Feb. 1, 1983).

Xu Shanjia et al. "Radiation Characteristics of Multilayer Periodic Dielectric Structures", International Journal of Infared and Millimeter Waves, Springer, Dordrecht, NL, vol. 11, No. 9, pp. 1047-1067 (Sep. 1, 1990).

Xu Shanjia et al., Effects of Groove Profile on the Performances of Grating Antennas, Merging Technologies for the 90's, [International Symposium on Antennas and Propagation], IEEE Dallas TX, vol. 4, pp. 1940-1943, (May 7-11, 1990).

EPO Search Report issued for EPO application No. 13763059.3 dated May 28, 2015.

From U.S. Appl. No. 13/931,097 (Unpublished, Non-Publication Requested), Final Rejection dated Dec. 13, 2016.

From U.S. Appl. No. 13/931,097 (Unpublished, Non-Publication Requested), Non-Final Rejection dated May 12, 2017.

* cited by examiner

WHEREIN THE ANTENNA SUPERSTRATE COMPRISES METAL PATCHES CONFIGURED WITH A SIZE AND SPACING IN ORDER TO IMPLEMENT THE EQUATION 100 114

$$Z_{sw}(x,y) = X + M\cos(k_0(n_0 r - x\sin\theta_0))$$

WHERE $x$, $y$ ARE THE COORDINATES OF A POINT ON THE FLAT SURFACE,
WHERE $X$ IS THE MEAN IMPEDANCE,
WHERE $M$ IS THE IMPEDANCE VARIATION,
WHERE $K_O=2\pi f_O/C$, WHERE $f_O$ IS THE DESIGN FREQUENCY,
WHERE $n_O = (1 + (X/377)^2)^{1/2}$ IS THE MEAN SURFACE WAVE INDEX, AND
WHERE $R = (x^2 + y^2)^{1/2}$

WHEREIN THE METALLIC PATCHES ARE PRINTED USING STANDARD PRINTED CIRCUIT BOARD TECHNIQUES 116

WHEREIN DETERMINING AN ANGLE $\theta_O$ BETWEEN A NORMAL TO THE SUBSTANTIALLY FLAT SURFACE AND A DIRECTION TO THE SATELLITE OR SATELLITES OF INTEREST COMPRISES USING A DEVICE THAT COMPRISES GLOBAL POSITIONING SATELLITE (GPS) AND ORIENTATION HARDWARE 118

WHEREIN MOUNTING THE AISA ON THE SUBSTANTIALLY FLAT SURFACE COMPRISES USING CONSTRUCTION ADHESIVE 120

FIG. 3B

AN INSTALLER LOCATING A SUBSTANTIALLY FLAT SURFACE HAVING A LINE OF SIGHT TO A SATELLITE OR SATELLITES OF INTEREST 130

AN INSTALLER DETERMINING AN ANGLE $\theta_O$ BETWEEN A NORMAL TO THE SUBSTANTIALLY FLAT SURFACE AND A DIRECTION TO THE SATELLITE OR SATELLITES OF INTEREST, AND INFORMING A VENDOR OF THE ANGLE $\theta_O$ 132

THE VENDOR FABRICATING AN AISA CONFIGURED FOR THE ANGLE $\theta_O$, AND SHIPPING THE AISA TO THE INSTALLER 134

THE INSTALLER MOUNTING THE AISA ON THE SUBSTANTIALLY FLAT SURFACE 136

WHEREIN THE AISA COMPRISES METAL PATCHES CONFIGURED WITH A SIZE AND SPACING IN ORDER TO IMPLEMENT THE EQUATION 138

$$Z_{\infty}(x,y) = X + M\cos(k_o(n_o r - x\sin\theta_o))$$

WHERE $x$, $y$ ARE THE COORDINATES OF A POINT ON THE FLAT SURFACE,
WHERE $X$ IS THE MEAN IMPEDANCE,
WHERE $M$ IS THE IMPEDANCE VARIATION,
WHERE $K_O=2\pi f_O/C$, WHERE $f_O$ IS THE DESIGN FREQUENCY,
WHERE $n_O = (1 + (X/377)^2)^{1/2}$ IS THE MEAN SURFACE WAVE INDEX, AND
WHERE $R = (x^2 + y^2)^{1/2}$

FIG. 4A

WHEREIN DETERMINING AN ANGLE $\theta_O$ BETWEEN A NORMAL 100
TO THE SUBSTANTIALLY FLAT SURFACE AND A DIRECTION TO
THE SATELLITE OR SATELLITES OF INTEREST COMPRISES
USING A DEVICE THAT COMPRISES GLOBAL POSITIONING
SATELLITE (GPS) AND ORIENTATION HARDWARE 140

FIG. 4B

AN INSTALLER LOCATING A SUBSTANTIALLY FLAT SURFACE HAVING A LINE OF SIGHT TO A SATELLITE OR SATELLITES OF INTEREST 150

THE INSTALLER DETERMINING AN ANGLE $\theta_O$ BETWEEN A NORMAL TO THE SUBSTANTIALLY FLAT SURFACE AND A DIRECTION TO THE SATELLITE OR SATELLITES OF INTEREST 152

THE INSTALLER PRINTING METALLIC PATCHES ON AN ANTENNA SUPERSTRATE, WHEREIN THE METALLIC PATCHES ARE CONFIGURED WITH A SIZE AND SPACING IN ORDER TO IMPLEMENT THE EQUATION $$Z_{sw}(x, y) = X + M\cos(k_o(n_o r - x\sin\theta_o))$$

WHERE $x$, $y$ ARE THE COORDINATES OF A POINT ON THE FLAT SURFACE,
WHERE $X$ IS THE MEAN IMPEDANCE,
WHERE $M$ IS THE IMPEDANCE VARIATION,
WHERE $K_O=2\pi f_O/C$, WHERE $f_O$ IS THE DESIGN FREQUENCY,
WHERE $n_O = (1 + (X/377)^2)^{1/2}$ IS THE MEAN SURFACE WAVE INDEX, AND 154
WHERE $R = (x^2 + y^2)^{1/2}$

THE INSTALLER LAMINATING THE ANTENNA SUPERSTRATE TO AN ANTENNA SUBSTRATE TO FORM THE AISA 156

THE INSTALLER MOUNTING THE AISA ON THE SUBSTANTIALLY FLAT SURFACE. 158

FIG. 5A

METHOD OF INSTALLING ARTIFICIAL IMPEDANCE SURFACE ANTENNAS FOR SATELLITE MEDIA RECEPTION

CROSS REFERENCE TO RELATED APPLICATIONS

This application is related to U.S. patent application Ser. No. 13/427,682, filed Mar. 22, 2012, which is incorporated herein as though set out in full.

TECHNICAL FIELD

This disclosure relates to artificial impedance surface antennas (AISAs).

BACKGROUND

There are many satellite media providers throughout the world. For example, satellite media providers in the United States include DirecTV, and DISH Network, and there are many more satellite media providers throughout the world, such as British Sky Broadcasting in the United Kingdom. There are also many satellite internet providers. In the United States satellite internet providers include HughesNet, Wildblue, Dish, and Spacenet.

To allow users on the ground to receive broadcast media from satellites and to receive and transmit to the satellites providing satellite internet, relatively large antenna dishes are needed. Often the antennas are installed on the sides or on the roofs of houses and businesses, and the result can be unsightly.

By their nature, the antenna dishes are large and bulky and are clumsy to install, transport and store. The installation process for an antenna dish is labor intensive and requires fastening the antenna dish to the support structure of the dwelling by drilling through walls or roofs into beams, studs or joists. Antenna dishes also require substantial warehouse floor space for storage.

The satellite media and internet providers often pay for the installation. Because the installer's labor time is a large percentage of the satellite media and/or satellite internet provider's operation cost, the providers are interested in minimizing this cost.

Artificial impedance surface antennas (AISAs) have been used in some satellite media and internet applications. AISAs are described by: D. Gregoire and J. Colburn, "Artificial impedance surface antenna design and simulation", Proc. 2010 Antenna Applications Symposium, pp. 288; by J. S. Colburn et al., "Scalar and Tensor Artificial Impedance Surface Conformal Antennas", 2007 Antenna Applications Symposium, pp. 526-540; and by B. H. Fong et al, "Scalar and Tensor Holographic Artificial Impedance Surfaces", IEEE Trans. Antennas Propagation, accepted for publication, 2010.

Artificial impedance surface antennas (AISAs) are less unsightly and are less clumsy to handle and store as compared to large antenna dishes. AISAs take up less space when stored, because they are essentially flat. However, AISA are more complex to fabricate and install than antenna dishes.

What is needed is an efficient low cost method for designing, fabricating, and installing artificial impedance surface antennas (AISAs) for satellite media and internet applications as well as other communication applications. The embodiments of the present disclosure answer these and other needs.

SUMMARY

In a first embodiment disclosed herein, a method for fabricating and installing an artificial impedance surface antenna (AISA) comprises locating a substantially flat surface having a line of sight to a satellite or satellites of interest, determining an angle $\theta_o$ between a normal to the substantially flat surface and a direction to the satellite or satellites of interest, selecting an antenna superstrate from a pre-fabbed stock of antenna superstrates, the selected antenna superstrate configured for having a peak radiation within two (2) degrees of the angle $\theta_o$, laminating the selected antenna superstrate to an antenna substrate to form the AISA, and mounting the AISA on the substantially flat surface.

In another embodiment disclosed herein, a method for fabricating and installing an artificial impedance surface antenna (AISA) comprises an installer locating a substantially flat surface having a line of sight to a satellite or satellites of interest, the installer determining an angle $\theta_o$ between a normal to the substantially flat surface and a direction to the satellite or satellites of interest, and informing a vendor of the angle $\theta_o$, the vendor fabricating an AISA configured for the angle $\theta_o$, and shipping the AISA to the installer, and the installer mounting the AISA on the substantially flat surface.

In yet another embodiment disclosed herein, a method for fabricating and installing an artificial impedance surface antenna (AISA) comprises an installer locating a substantially flat surface having a line of sight to a satellite or satellites of interest, the installer determining an angle $\theta_o$ between a normal to the substantially flat surface and a direction to the satellite or satellites of interest, the installer printing metallic patches on an antenna superstrate, wherein the metallic patches are configured with a size and spacing in order to implement the equation $Z_{sw}(x,y)=X+M\cos(k_o(n_o r - x\sin\theta_o))$ where x, y are the coordinates of a point on the flat surface, where X is the mean impedance, where M is the impedance variation, where $k_o=\pi f_o/c$, where $f_o$ is the design frequency, where $n_o=(1+(X/377)^2)^{1/2}$ is the mean surface wave index, and where $r=(x^2+y^2)^{1/2}$, the installer laminating the antenna superstrate to an antenna substrate to form the AISA, and the installer mounting the AISA on the substantially flat surface.

These and other features and advantages will become further apparent from the detailed description and accompanying figures that follow. In the figures and description, numerals indicate the various features, like numerals referring to like features throughout both the drawings and the description.

BRIEF DESCRIPTION OF THE DRAWINGS

FIGS. 3A and 3B are a flow diagram of a method of fabricating and installing an artificial impedance surface antenna (AISA) in accordance with the present disclosure;

FIGS. 4A and 4B are a flow diagram of another method of fabricating and installing an artificial impedance surface antenna (AISA) in accordance with the present disclosure; and FIGS. 5A and 5B are a flow diagram of yet another method of fabricating and installing an artificial impedance surface antenna (AISA) in accordance with the present disclosure.

DETAILED DESCRIPTION

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

Figure 1:
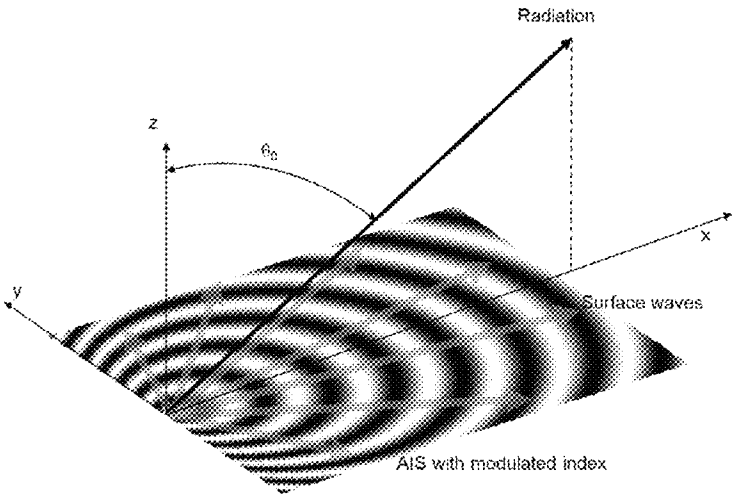
FIG. 1 PRIOR ART
FIG. 1 illustrates the operating principle for artificial impedance surface antennas in accordance with the prior art.

Artificial impedance surface antennas (AISAs), also known as holographic antennas, operate by launching a surface wave across an artificial impedance surface with a so-called "holographic" impedance map that causes the surface wave to radiate into free space in a highly-directional beam, as illustrated in FIG. 1.

Figure 2:
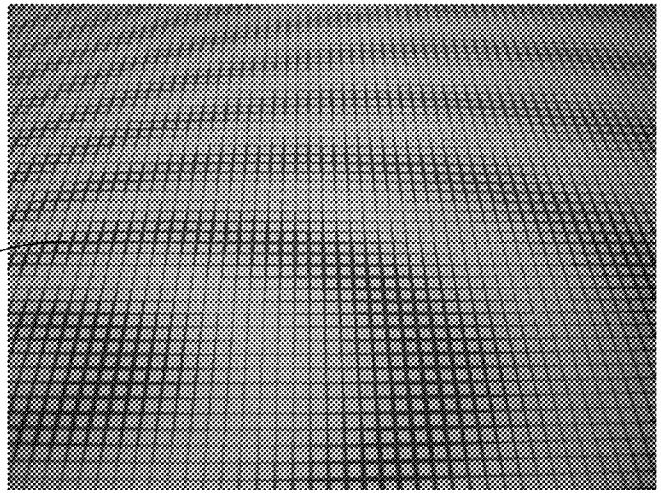
FIG. 2 PRIOR ART
FIG. 2 shows an artificial impedance surface antenna implemented using square metallic patches in accordance with the prior art.

An AISA may be made by printing an array of metallic patches onto a dielectric substrate. In the prior art, standard circuit board fabrication techniques have been used to print the patches 20 to form an AISA 10, such as that shown in FIG. 2. The patches 20 vary in size and/or shape to produce a local value for the surface-wave impedance.

The surface-wave impedance mapping function determines the angle and directivity of the AISAs radiation. The methods for producing this map are well documented in the literature.

The surface wave impedance map for a flat AISA is $$Z_{sw}(x,y)=X+M\cos(k_o(n_o r-x\sin\theta_o)) \quad (1)$$

where $Z_{SW}(x,y)$ is a surface wave impedance at coordinates x, y, where x, y are the coordinates of a point on the flat surface of the AISA, where X is the mean impedance, where M is the impedance variation, where $k_o=2\pi f_o/c$, where $f_o$ is the design frequency, where $n_o=(1+(X/377)^2)^{1/2}$ is the mean surface wave index, and where $r=(x^2+y^2)^{1/2}$.

The angle $\theta_o$ is the angle of the radiation with respect to the normal to the surface, as shown in FIG. 1.

Once the impedance map is determined according to equation (1) above, a corresponding metallic patch is placed on the surface at each position. The size of the patch and the distance to neighboring patches fixes the impedance at the correct value. The relation between patch size, spacing and dielectric properties is a complex formula that is well known to those skilled in the art. On the flat surface, the patches are typically distributed in a square array that simplifies controlling the patch size and spacing.

The metallic patches may be printed onto a dielectric substrate using standard printed circuit board (PCB) techniques, or the patches may be printed onto a thin plastic film using PCB or other techniques. The thin plastic film may then be laminated onto a dielectric substrate.

Because an AISA satellite antenna is a flat antenna, an AISA may be mounted directly to a residential wall. For example, construction adhesive may be used to attach the AISA to a wall.

Advantages of an AISA include:

1) an AISA is easier and quicker to install than a dish antenna, 2) mounting an AISA does not require fastening mounting structures to a building's support structure, 3) an AISA is far less obtrusive because it is flat, and can be the same color as a building wall, 4) because an AISA is flat and less obtrusive, an AISA may not be subject to local building codes or home owner association (HOA) rules, and 5) an AISA may be low cost because an AISA can be fabricated using plastic and metal coated plastic films.

The following describes a method of designing, fabricating and installing artificial impedance surface antennas (AISAs).

First, the installer locates a flat surface on the wall or roof of the dwelling where the antenna will be mounted. The mounting location needs to have a line of sight to the satellite or satellites of interest, and ideally, the angle between the normal to the wall and the direction to the satellite is approximately less than 60 degrees. This requirement is usually relatively easy to satisfy, because walls are usually 90 degrees relative to each other. So if one wall's angle between the normal to the wall and the direction to the satellite is more than 60 degrees, then the adjacent wall's angle between the normal to the wall and the direction to the satellite will be less than 30 degrees. The installer does not need to determine the dwelling's support structure, since the AISA is light weight. Also, because an AISA may be mounted flush to a wall, the AISA is much less affected by high winds compared to a dish antenna, so the attachment does not need to be to a building's support structure.

To design the AISA antenna, the exact angle between the normal for the wall to which the AISA is mounted and the satellite direction, which is parameter $\theta_o$ in equation (1) above, needs to be determined. All the other parameters in equation (1) depend on the AISA antenna substrate and other systematic parameters that may be optimized and fixed for all antennas, or at least a group of antennas and are a function of the desired design frequency $f_0$.

One method for determining the parameter $\theta_o$ is to use a computerized application or app that resides in a computer that includes global positioning satellite (GPS) and orientation hardware. Such computers are already for sale, (e.g. the Apple iPad, or many smart phones). To determine the parameter $\theta_o$ using one of these devices, the installer may place the device, such as an Apple iPad, against the wall in the antenna's location. Then the GPS and orientation software would determine the correct angle $\theta_o$ for that location.

The color of the AISA antenna may also be selected. The AISA antenna color can either match the wall color so that the antenna blends in, or it can be made to be a color that coordinates with other colors on the residence or business to which the AISA is mounted.

An antenna superstrate may then be fabricated or selected from a stock of pre-fabbed antenna superstrates. An antenna superstrate is a thin plastic film that the metal patches 20 may be printed on.

The pre-fabbed antenna superstrates can easily be stored in the installer's service truck. Only about 20 variations of antenna superstrates are needed to cover all situations, because the antenna design only depends on $\theta_o$, which in almost all situations will only vary from 20 to 60 degrees. The angle resolution necessary to fine tune the antenna alignment to within 0.1 degrees may be obtained by using shims to tilt the antenna by up to 2 degrees with respect to the wall on which the antenna is mounted. Further, because the antennas may all have the same AISA substrate, only variations of the antenna superstrates need to be stored, and because the antenna superstrates may have a thickness of only 0.001 inches, thousands of antenna superstrates may be stored in a very small space.

Once the installer knows which antenna superstrate to use, the installer can proceed to laminate the antenna superstrate to an AISA substrate, which may be dielectric which can be plastic, to form an AISA antenna. Then the installer mounts the AISA on the chosen wall.

In another method, an AISA antenna may be fabricated for a custom installation. The installer may call in the parameter $\theta_o$ and the AISA color for the mounting location to a vendor. The vendor then can rapidly print the metal patches onto a plastic film of the right color to form an antenna superstrate, and then laminate the antenna superstrate to an AISA substrate to form the AISA antenna, which the vendor can then ship to the installer.

In another embodiment for custom fabrication of an AISA antenna, the installer inputs the parameter $\theta_o$ into a computer or other such device, and runs a program on the computer to drive a metal-ink printer, which can be in the service truck. The program causes the metal-ink printer to rapidly print out the antenna superstrate onto an appropriately colored plastic sheet. Then the installer can laminate the antenna superstrate to an AISA substrate to form the AISA antenna. In this embodiment, the installer has all the equipment necessary to perform the design, fabrication, and installation of the AISA antenna, which saves time and lowers installation costs.

In either embodiment, the installer aligns the fabricated AISA antenna on the wall and temporarily fixes the AISA antenna onto the wall. Then the installer can fine-tunes the alignment with shims as necessary to optimize the satellite reception. Finally the installer can complete the installation of the AISA antenna by securing the AISA antenna to the wall with construction adhesive. Clearly, other ways well known in the art of securing the AISA antenna to the wall may also be used.

Figure 3A:
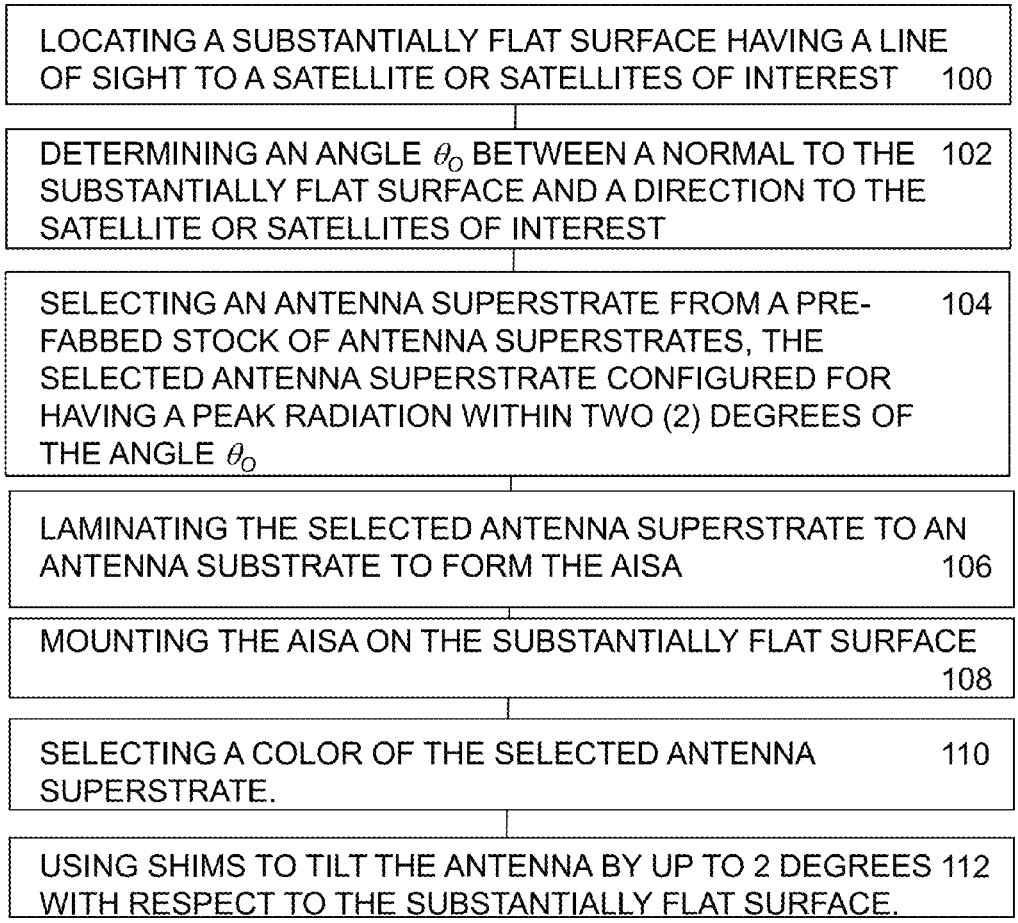

FIGS. 3A and 3B are a flow diagram of a method for fabricating and installing an artificial impedance surface antenna. In step 100 a substantially flat surface is located having a line of sight to a satellite or satellites of interest. Then in step 102 an angle $\theta_o$ is determined between a normal to the substantially flat surface and a direction to the satellite or satellites of interest. Next in step 104 an antenna superstrate is selected from a pre-fabbed stock of antenna superstrates, the selected antenna superstrate configured for having a peak radiation within two (2) degrees of the angle $\theta_o$. Then in step 106 the selected antenna superstrate is laminated to an antenna substrate to form the AISA, and finally in step 108 the AISA is mounted on the substantially flat surface.

In step 110 selecting an antenna superstrate from a pre-fabbed stock of antenna superstrates includes selecting a color of the selected antenna superstrate. In step 112 mounting the AISA on the substantially flat surface includes fine tuning the antenna angle $\theta_o$ alignment to within 0.1 degrees between a normal to the substantially flat surface and a direction to the satellite or satellites of interest by using shims to tilt the antenna by up to 2 degrees with respect to the substantially flat surface.

In step 114, the antenna superstrate comprises metal patches configured with a size and spacing in order to implement the equation $$Z_{sw}(x,y)=X+M\cos(k_o(n_o r-x\sin\theta_o))$$

where $Z_{SW}(x,y)$ is a surface wave impedance at coordinates x, y, where x, y are the coordinates of a point on the antenna superstrate mounted on the substantially flat surface, where X is the mean impedance, where M is the impedance variation, where $k_o=2\pi f_o/c$, where $f_o$ is the design frequency, where $n_o=(1+(X/377)^2)^{1/2}$ is the mean surface wave index, and where $r=(x^2+y^2)^{1/2}$.

In step 116 the metallic patches are printed using standard printed circuit board techniques. In step 118 determining an angle $\theta_o$ between a normal to the substantially flat surface and a direction to the satellite or satellites of interest includes using a device that comprises global positioning satellite (GPS) and orientation hardware. In step 120 mounting the AISA on the substantially flat surface includes using construction adhesive.

FIGS. 4A and 4B are a flow diagram of another method for fabricating and installing an artificial impedance surface antenna. In step 130 an installer locates a substantially flat surface having a line of sight to a satellite or satellites of interest. Then in step 132 the installer determines an angle $\theta_o$ between a normal to the substantially flat surface and a direction to the satellite or satellites of interest, and informs a vendor of the angle $\theta_o$. Then in step 134 the vendor fabricates an AISA configured for the angle $\theta_o$, and ships the AISA to the installer. Finally in step 136 the installer mounts the AISA on the substantially flat surface.

In step 138 the AISA comprises metal patches configured with a size and spacing in order to implement the equation $$Z_{sw}(x,y)=X+M\cos(k_o(n_o r-x\sin\theta_o))$$

where x, y are the coordinates of a point on the flat surface, where X is the mean impedance, where M is the impedance variation, where $k_o=2\pi f_o/c$, where $f_o$ is the design frequency, where $n_o=(1+(X/377)^2)^{1/2}$ is the mean surface wave index, and where $r=(x^2+y^2)^{1/2}$.

In step 140, determining an angle $\theta_o$ between a normal to the substantially flat surface and a direction to the satellite or satellites of interest includes using a device that comprises global positioning satellite (GPS) and orientation hardware.

Figure 5B:
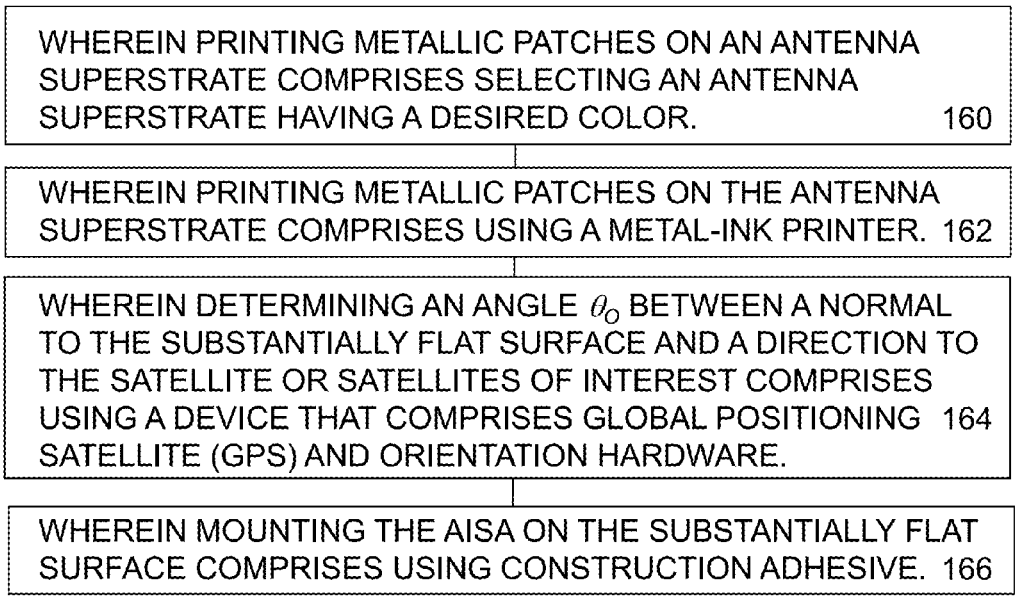

FIGS. 5A and 5B are flow diagrams of yet another method for fabricating and installing an artificial impedance surface antenna. In step 150 an installer locates a substantially flat surface having a line of sight to a satellite or satellites of interest. Then in step 152 the installer determines an angle $\theta_o$ between a normal to the substantially flat surface and a direction to the satellite or satellites of interest. Next in step 154 the installer prints metallic patches on an antenna superstrate, wherein the metallic patches are configured with a size and spacing in order to implement the equation $$Z_{sw}(x,y)=X+M\cos(k_o(n_o r-x\sin\theta_o))$$

where $Z_{SW}(x,y)$ is a surface wave impedance at coordinates x, y, where x, y are the coordinates of a point on the antenna superstrate mounted on the substantially flat surface, where X is the mean impedance, where M is the impedance variation, where $k_o=2\pi f_o/c$, where $f_o$ is the design frequency, where $n_o=(1+(X/377)^2)^{1/2}$ is the mean surface wave index, and where $r=(x^2+y^2)^{1/2}$.

Then in step 156 the installer laminates the antenna superstrate to an antenna substrate to form the AISA. Finally in step 158 the installer mounts the AISA on the substantially flat surface.

In step 160 printing metallic patches on an antenna superstrate includes selecting an antenna superstrate having a desired color. In step 162 printing metallic patches on the antenna superstrate includes using a metal-ink printer. In step 164 determining an angle $\theta_o$ between a normal to the substantially flat surface and a direction to the satellite or satellites of interest includes using a device that comprises global positioning satellite (GPS) and orientation hardware. In step 166 mounting the AISA on the substantially flat surface includes using construction adhesive.

Having now described the invention in accordance with the requirements of the patent statutes, those skilled in this art will understand how to make changes and modifications to the present invention to meet their specific requirements or conditions. Such changes and modifications may be made without departing from the scope and spirit of the invention as disclosed herein.

The foregoing Detailed Description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. Applicant has made this disclosure with respect to the current state of the art, but also contemplates advancements and that adaptations in the future may take into consideration of those advancements, namely in accordance with the then current state of the art. It is intended that the scope of the invention be defined by the Claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the Claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "comprising the step(s) of . . . ."

What is claimed is:

1. A method for providing an artificial impedance surface antenna (AISA), comprising:

locating a substantially flat surface having a line of sight to a satellite or satellites of interest;

determining an angle $\theta_o$ between a normal to the substantially flat surface and a direction to the satellite or satellites of interest;

selecting an antenna superstrate from a pre-fabbed stock of antenna superstrates, the selected antenna superstrate configured for having a peak radiation within two (2) degrees of the angle $\theta_o$; and mounting the selected antenna superstrate on the substantially flat surface.

2. The method of claim 1, wherein:

selecting an antenna superstrate from a pre-fabbed stock of antenna superstrates comprises selecting a color of the selected antenna superstrate.

3. The method of claim 1, wherein:

mounting the selected antenna superstrate on the substantially flat surface comprises fine-tuning the antenna angle $\theta_o$ alignment to within 0.1 degrees between a normal to the substantially flat surface and a direction to the satellite or satellites of interest by using shims to tilt the antenna by up to 2 degrees with respect to the substantially flat surface.

4. The method of claim 1, wherein the antenna superstrate is a dielectric or thin plastic film.

5. The method of claim 1, wherein the antenna superstrate has a thickness of only 0.001 inch.

6. The method of claim 1, further comprising:

laminating the selected antenna superstrate to an antenna substrate.

7. The method of claim 6, wherein the antenna substrate comprises a dielectric.

8. The method of claim 1, wherein the antenna superstrate comprises metallic patches configured with a size and spacing in order to implement the equation $$Z_{sw}(x,y)=X+M\cos(k_o(n_o r-x\sin\theta_o))$$

where $Z_{SW}(x,y)$ is a surface wave impedance at coordinates x, y, where x, y are the coordinates of a point on the antenna superstrate mounted on the substantially flat surface, where X is the mean impedance, where M is the impedance variation, where $k_o=2\pi f_o/c$, where $f_o$ is the design frequency, where $n_o=(1+(X/377)^2)^{1/2}$ is the mean surface wave index, and where $r=(x^2/y^2)^{1/2}$.

9. The method of claim 8, wherein the metallic patches are printed using standard printed circuit board techniques.

10. The method of claim 1, wherein the pre-fabbed stock of antenna superstrates are configured as a function of a desired design frequency $f_0$.

11. The method of claim 1, wherein determining an angle $\theta_o$ between a normal to the substantially flat surface and a direction to the satellite or satellites of interest comprises:

using a device that comprises global positioning satellite (GPS) and orientation hardware.

12. The method of claim 1, wherein mounting the selected antenna superstrate on the substantially flat surface comprises using construction adhesive.

13. A method for fabricating and installing an artificial impedance surface antenna (AISA), comprising:

an installer locating a substantially flat surface having a line of sight to a satellite or satellites of interest;

the installer determining an angle $\theta_o$ between a normal to the substantially flat surface and a direction to the satellite or satellites of interest;

the installer printing metallic patches on an antenna superstrate, wherein the metallic patches are configured with a size and spacing in order to implement the equation $$Z_{sw}(x,y)=X+M\cos(k_o(n_o r-x\sin\theta_o))$$

where $Z_{SW}(x,y)$ is a surface wave impedance at coordinates x, y, where x, y are the coordinates of a point on the antenna superstrate mounted on the substantially flat surface, where X is the mean impedance, where M is the impedance variation, where $k_o=2\pi f_o/c$, where $f_o$ is the design frequency, where $n_o=(1+(X/377)^2)^{1/2}$ is the mean surface wave index, and where $r=(x^2/y^2)^{1/2}$;

the installer laminating the antenna superstrate to an antenna substrate to form the AISA; and the installer mounting the AISA on the substantially flat surface.

14. The method of claim 13, wherein:

printing metallic patches on an antenna superstrate comprises selecting an antenna superstrate having a desired color.

15. The method of claim 13, wherein the antenna superstrate is a dielectric or thin plastic film.

16. The method of claim 13, wherein the antenna superstrate has a thickness of only 0.001 inch.

17. The method of claim 13, wherein the antenna substrate comprises a dielectric.

18. The method of claim 13, wherein printing metallic patches on the antenna superstrate comprises using a metal-ink printer.

19. The method of claim 13, wherein determining an angle $\theta_o$ between a normal to the substantially flat surface and a direction to the satellite or satellites of interest comprises:

using a device that comprises global positioning satellite (GPS) and orientation hardware.

20. The method of claim 13, wherein mounting the AISA on the substantially flat surface comprises using construction adhesive.

* * * * *